US005718196A

United States Patent [19]

Uchiyama et al.

[11] Patent Number: 5,718,196

[45] Date of Patent: Feb. 17, 1998

[54] LUBRICATION AND CAMSHAFT CONTROL SYSTEM FOR ENGINE

[75] Inventors: Shigenobu Uchiyama; Masaaki Yoshikawa; Hironao Takahashi, all of Iwata, Japan

[73] Assignee: Yamaha Hatsudoki Kabushiki Kaisha, Iwata, Japan

[21] Appl. No.: 534,566

[22] Filed: Sep. 27, 1995

[30] Foreign Application Priority Data

Sep. 30, 1994 [JP] Japan ..... 6-261824
Sep. 30, 1994 [JP] Japan ..... 6-261825
Sep. 30, 1994 [JP] Japan ..... 6-261826

[51] Int. Cl.[6] ..... F02F 7/00; F01L 1/34; F01M 1/00

[52] U.S. Cl. ..... 123/195 C; 123/90.17; 123/41.33; 123/41.44; 123/196 R; 123/196 AB

[58] Field of Search ..... 123/90.15, 90.17, 123/41.33, 41.44, 196 AB, 196 R, 195 C, 90.31

[56] References Cited

U.S. PATENT DOCUMENTS 2,191,459 2/1940 Duncan ..... 123/90.17
4,787,345 11/1988 Thoma ..... 123/90.15
5,301,639 4/1994 Satou ..... 123/90.17
5,333,577 8/1994 Shinojima ..... 123/90.15
5,353,755 10/1994 Matsuo et al. ..... 123/90.17
5,406,910 4/1995 Wallin ..... 123/41.33

FOREIGN PATENT DOCUMENTS 9324737 2/1993 WIPO .

OTHER PUBLICATIONS

European Search Report dated Oct. 1996.

*Primary Examiner*—Noah P. Kamen
*Attorney, Agent, or Firm*—Knobbe, Martens, Olson & Bear LLP

[57] ABSTRACT

An internal combustion engine having a variable valve timing mechanism with a hydraulic control that is mounted on the front of the cylinder head for ease of accessibility and for ease of conversion of the existing engine. The engine includes an oil filter, oil cooler, and coolant pump, which are disposed and driven in a way so as to maintain short flow paths and permit internal conduits to be formed in the engine so as to avoid the possibility of leakage. The variable valve timing mechanism is controlled by hydraulic pressure supplied by the lubricating system, and a control valve assembly is mounted on the cover for the variable valve timing mechanism with the control passages being formed integrally in this cover. In addition, one of the timing chains may be easily accessed for adjustment without removing the cover through the removal of a bolt that holds an accessory mounting bracket to the engine.

30 Claims, 14 Drawing Sheets

LUBRICATION AND CAMSHAFT CONTROL SYSTEM FOR ENGINE

BACKGROUND OF THE INVENTION

This invention relates to an internal combustion engine and more particularly to a lubrication system and associated components for an internal combustion engine.

As the requirements for increased engine performance both in the terms of power output and fuel economy and emission control increase, the actual construction of the engine becomes more complicated. For example, to improve the operating efficiency, it has been the practice to utilize overhead valves which are operated by one or more camshafts mounted directly in the cylinder head. In order to improve the engine performance throughout its entire running range, it has also been the practice to employ a mechanism between the camshaft and its drive that permits the phase of the camshaft relative to the crankshaft to be adjusted while the engine is running. In this way, optimum valve timing can be obtained under all running conditions.

Of course, all of the major components of the engine, including the camshafts and their drive must be lubricated. In addition, it has been the practice to employ a hydraulic actuator for actuating the variable valve timing mechanism (VVT). This hydraulic actuation for the VVT system often times utilizes the lubricant from the engine for its actuation. This adds to the number of hydraulic circuits that must be employed in the engine. The formation of these circuits and the respective passages of them can present some difficulties. In addition, the hydraulic control for the variable valve timing mechanism requires some form of valve and/or actuator and this further complicates these problems.

It is, therefore, a principal object of this invention to provide an improved and simplified lubricating system for an internal combustion engine.

It is a further object of this invention to provide an improved and simplified actuator for the variable valve timing mechanism of an internal combustion engine.

Although VVT mechanisms improve the performance of the engine, they add to their cost. There may be times, therefore, when the manufacturer may not wish to employ a VVT system with all engines in a given family of engines. It is important that the VVT system be such that it can be easily installed or deleted from an engine or engines of the same basic architecture. The prior systems, because of their complexity and construction have not offered this versatility.

It is, therefore, another object of this invention to provide a VVT mechanism that can be easily added to or deleted from a given engine or engines.

The valve actuating mechanism and the variable valve timing mechanism are components of the engine which may, at times, require servicing. Therefore, it is also desirable that the variable valve timing mechanism and the control therefor be positioned in a location where they can be relatively easily accessed.

It is, therefore, a still further object of this invention to provide an improved variable valve timing mechanism and actuator therefor that are disposed so that they can be easily accessed.

It is a further object of this invention to provide a control for a variable valve timing mechanism which is protected and yet is mounted on a portion of the engine where it can be easily accessed and wherein the fluid flow paths to and from the valve mechanism of the control can be easily formed.

For the reasons already noted, it is a common practice to employ one or more overhead camshafts for operating the valves of an engine. The camshaft or camshafts should be driven in timed relationship with the engine crankshaft, even if a variable valve timing mechanism is employed. Frequently, flexible transmitters are utilized for this purpose. The two-to-one speed reduction between the speed of rotation of the crankshaft and that of the camshaft is accomplished through one or more flexible transmitter transmissions in many engines.

As is well known, the flexible transmitters tend to elongate with use. This elongation does not deteriorate the performance of the transmission but it is desirable to maintain uniform tension on the flexible transmitter. Therefore, when the transmitter elongates, an adjustment in the tensioner mechanism may be required.

As the number of accessories and auxiliaries for the engine increase, the drive mechanism for them also becomes more complicated. Since these accessories are generally driven off of the crankshaft or other shafts driven by the engine crankshaft, then the accessibility of the camshaft driving mechanism may become complicated. This can complicate the servicing of the drive and particularly the tensioning of the flexible transmitters.

It is, therefore, a further object of this invention to provide an improved adjustment mechanism for a flexible transmitter transmission of an internal combustion engine.

It is a further object of this invention to provide an improved chain tensioner for the camshaft drive arrangement of an internal combustion engine.

It is yet another object of this invention to provide a flexible transmitter transmission for driving the camshaft of an engine which is contained within a protective cover and which can be adjusted without necessitating removal of the cover.

It should be apparent from the foregoing description that the demands on the lubricating system of an internal combustion engine are magnified and critical to engine performance. In addition to lubricating the engine and providing a source of fluid pressure for actuating such devices as variable valve timing mechanisms, the lubricant also is employed for cooling the engine. However, it is also well known that lubricants can deteriorate if their temperature becomes excessive.

It is, therefore, a still further object of this invention to provide a cooling system for the lubricant of an internal combustion engine.

Although engine oil coolers are well known, it is also known that it is important to provide some system for heat exchange between the lubricant and the atmosphere. Although air cooled oil coolers are possible, these devices generally must be mounted apart from the engine and thus require additional plumbing connections.

It has also been proposed to employ engine oil coolers that exchange heat from the lubricant to the coolant which is utilized to cool the other components of the engine. However, such arrangements require fluid paths for both the lubricant and the coolant.

It is, therefore, a principal object of this invention to provide an improved oil cooler arrangement for an internal combustion engine.

It is a still further object of this invention to provide an engine oil cooler that can be integrated with the engine cooling system and this is done without the necessity of external plumbing connections.

SUMMARY OF THE INVENTION

A first feature of this invention is adapted to be embodied in an internal combustion engine having an engine member upon which a camshaft is journaled at least in part. A timing drive is positioned at one end of the engine member and is driven from an engine crankshaft. A timing cover is formed at the one end of the engine member and encloses with the engine member at least in part the timing drive. A hydraulically operated variable valve timing mechanism couples the timing drive with the camshaft and is effective for varying the timing of the camshaft relative to the crankshaft. A source of hydraulic fluid under pressure is provided for controlling and operating the variable valve timing mechanism. A valve assembly is mounted on the timing drive cover for controlling the supply of hydraulic fluid from the hydraulic fluid source to the hydraulically operated variable valve timing mechanism for controlling its operation.

Another feature of the invention is adapted to be embodied in an internal combustion engine having a camshaft journaled therein. A flexible transmitter is driven by an engine crankshaft for driving the camshaft. The flexible transmitter is enclosed at least in part within a timing case. A transmitter tensioner is associated with the flexible transmitter and is supported on a pivot bolt for engaging the flexible transmitter and maintaining the tension thereon. The pivot bolt is contained within the timing case. An outer surface of the timing case has a threaded opening aligned with the pivot bolt and through which the pivot bolt may be accessed. An attachment bolt affixes an attachment to the timing case and has a threaded portion received within the threaded opening of the timing case for removably closing this opening as well as affixing the attachment to the timing case. This threaded bolt may be removed for accessing the pivot bolt and adjusting the tension of the flexible transmitter.

Another feature of the invention is adapted to be embodied in an internal combustion engine that is comprised of a cylinder block closed at its lower end by a crankcase in which a crankshaft rotates. An oil pump is driven from the crankshaft and is disposed on the side of a plane containing the axis of rotation of the crankshaft opposite to the cylinder block. An oil filter for the engine is mounted on the lower portion of the cylinder block and through which oil is circulated by the oil pump. The engine has a cooling jacket. A cooling pump is driven by the crankshaft and is positioned on the side of the plane on which the cylinder block lies. An oil cooling jacket is associated with the oil filter for cooling the oil which passes therethrough. Means are provided for circulating coolant from the coolant pump through the oil cooler jacket.

BRIEF DESCRIPTION OF THE DRAWINGS

FIG. 3 is a further front elevational view, in part similar to FIGS. 1 and 2 with the timing drive mechanism removed but some of the components which are removed from FIG. 2 and particularly the variable valve timing control mechanism being shown in place.

FIG. 5 is a top plan view with the cam cover and certain additional covers removed showing the valve timing arrangement and with a portion of the variable valve timing mechanism broken away to more clearly show its construction.

DETAILED DESCRIPTION OF THE PREFERRED EMBODIMENT OF THE INVENTION

Figure 1:
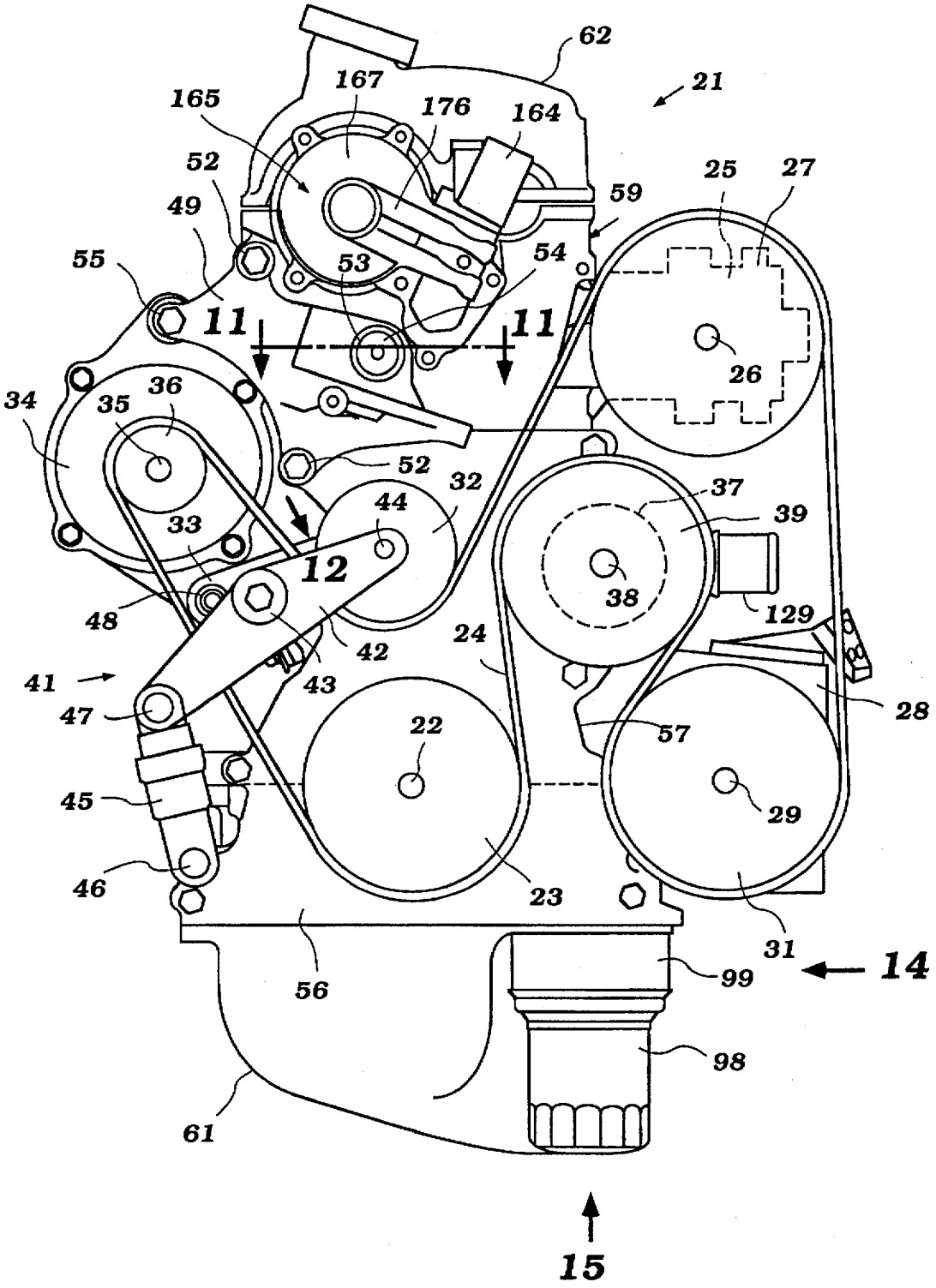
FIG. 1 is a front elevational view of an internal combustion engine constructed in accordance with an embodiment of the invention.

Referring now in detail to the drawings and initially to FIG. 1, an internal combustion engine constructed in accordance with a first embodiment of the invention is shown in front elevational view and is identified generally by the reference numeral 21. In the illustrated embodiment, the engine 21 is of the four cycle, multiple cylinder in-line type. Although the invention is described in conjunction with an in-line type of engine, it will be readily apparent to those skilled in the art how the invention may be applied to a V-type engine. Generally, the construction as illustrated would be applied to each bank of such a V-type engine, although other applications to V-type engines are possible. The particular number of cylinders employed for the engine 21 is not an important feature of the invention, but it should be noted that the engine 21 is liquid cooled.

As may be seen in FIG. 1, the engine 21 has a crankshaft 22 that extends through the front portion of the body of the engine and which is journaled in the engine in a well known manner. A drive pulley 23 is affixed to the exposed end of the crankshaft 22 and drives a drive belt 24 which, in turn, drives a number of engine accessories. These engine accessories are comprised of a power steering pump 25 that has a drive shaft 26 to which a pulley 27 is affixed. The pulley 27 is driven by the drive belt 24. In addition, an air conditioning compressor 28 is mounted on the same side of the engine 21 as the power steering pump 25 and has a drive shaft 29 to which a pulley 31 is affixed. The pulley 31 is also driven by the drive belt 24.

An idler pulley 32 is mounted on the opposite side of the engine in a manner to be described on means that include an alternator mounting lug 33, and engages the drive belt 24 to maintain it in engagement with the crankshaft pulley 23 and to control the tension of the drive belt 24. An alternator or generator, indicated generally by the reference numeral 34, is mounted in part on the alternator lug 33 in a manner which also will be described. The alternator has an alternator shaft 35. A pulley 36 is affixed to the alternator shaft 35 and is also driven by the drive belt 24.

A water pump assembly, indicated generally by the reference numeral 37 and formed in a manner to be described, is mounted on the front face of the engine 21 in a manner which will be described. This water pump 37 has an impeller shaft 38 to which a pulley 39 is affixed. The pulley 39 is also driven by the drive belt 24.

In order to permit the single drive belt 24 to drive all of the described accessories, it is necessary that their respective pulleys 27, 31, 36 and 39, as well as the idler pulley 32 and the crankshaft pulley 23, to lie in a common plane. The layout of the components of the engine permits this to be achieved.

It has been noted that the idler pulley 32 serves to maintain the tension in the drive belt 24. For this purpose, a belt tensions mechanism, indicated generally by the reference numeral 41 is provided. This belt tension mechanism 41 is comprised of a bellcrank 42 that is mounted on the alternator mounting lug 33 by means of a mounting bolt 43 so that the bellcrank 42 may pivot. The idler pulley 32 is journaled on a shaft 44 which is fixed to one end of the bellcrank 42. A hydraulically operated tensioner 45 is pivotally mounted on the engine 21 by a pivot bolt 46. The hydraulically operated tensioner 45 has a piston rod that has a pivotal connection 47 to the other end of the bell crank 42. Hence, when the hydraulic tension 45 is pressurized, the bellcrank 42 will pivot and the idler pulley 32 will maintain the desired pretension on the belt 24. As the speed of the engine increases and the oil pressure increases, the belt tension will also increase proportionately.

As has been noted, the alternator 34 is mounted in part on the mounting lug 33. This is accomplished in part by a mounting bolt 48 that is threaded into the alternator mounting lug 33. In addition, an alternator mounting plate 49 is mounted to the front of the engine by means of a pair of bolts 52 and a further fastener, indicated generally by the reference numeral 53. This further fastener 53 has a socketed portion 54 so as to receive a special tool and serves the dual purpose of holding the alternator mounting bracket 49 to the front of the engine 21 and also to permit adjustment of a timing chain for the engine, in a manner which will be described.

The alternator 34 is affixed to the alternator mounting plate 49 by means of a fastener 55. Hence, the fasteners 55 and 48 serve the purpose of mounting the alternator 34 to the engine 21 in addition to the special fastener 53. This permits the special fastener 53 to be removed for servicing while the alternator 34 is still in place.

Figure 2:
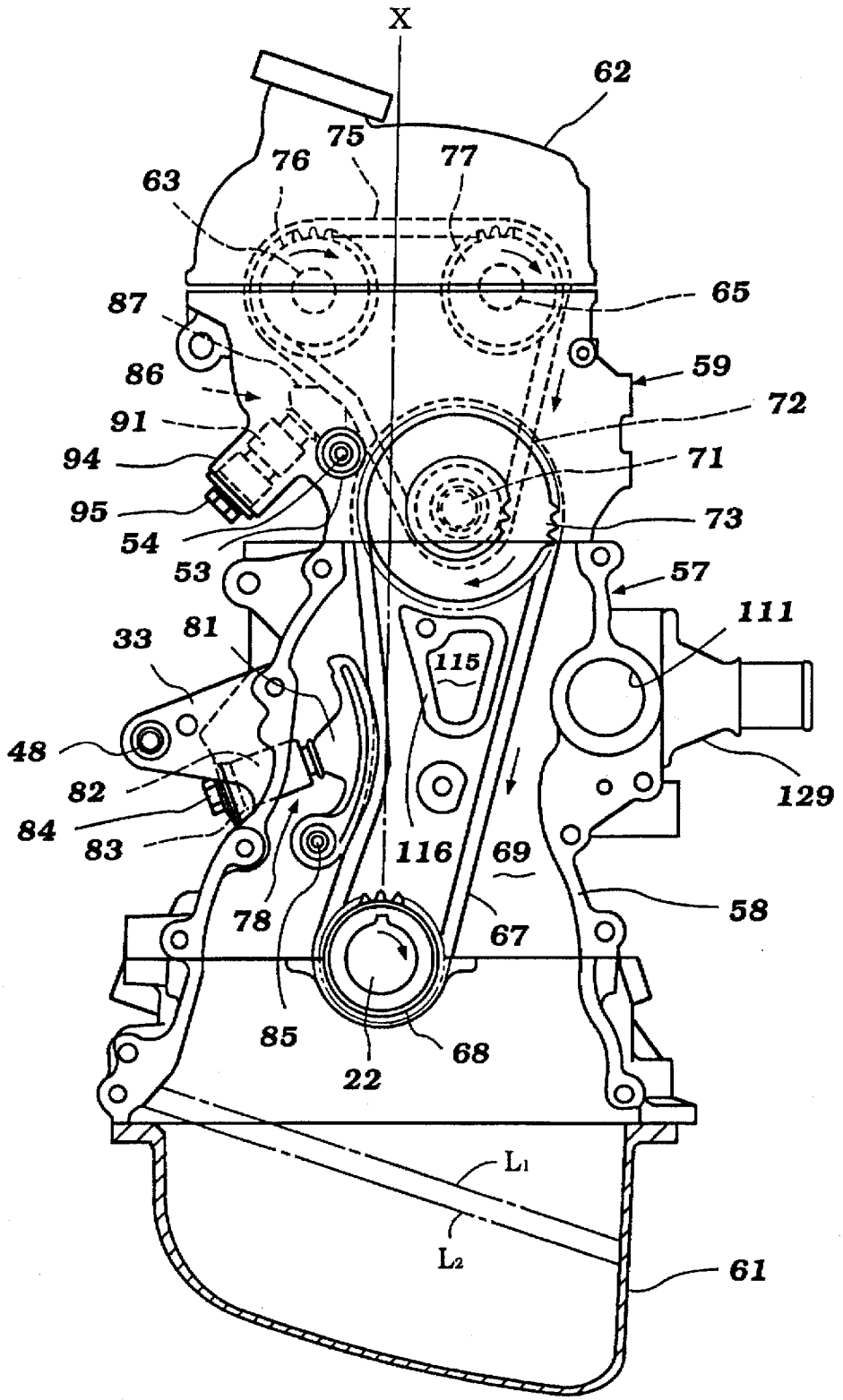
FIG. 2 is a view taken in the same direction as FIG. 1 but with the engine driven accessories removed and certain of the front covers of the engine also removed.
Figure 2:
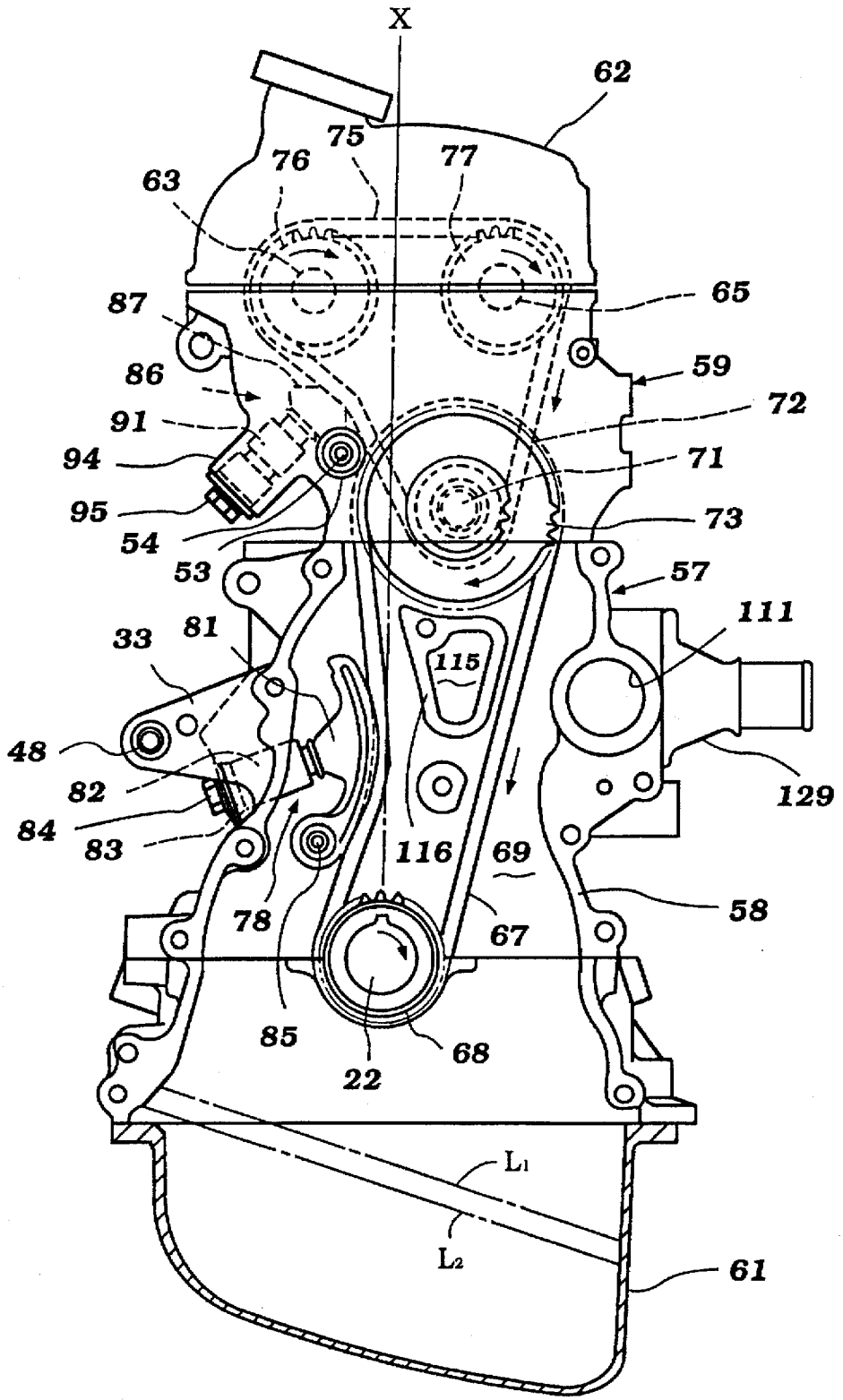
Figure 4:
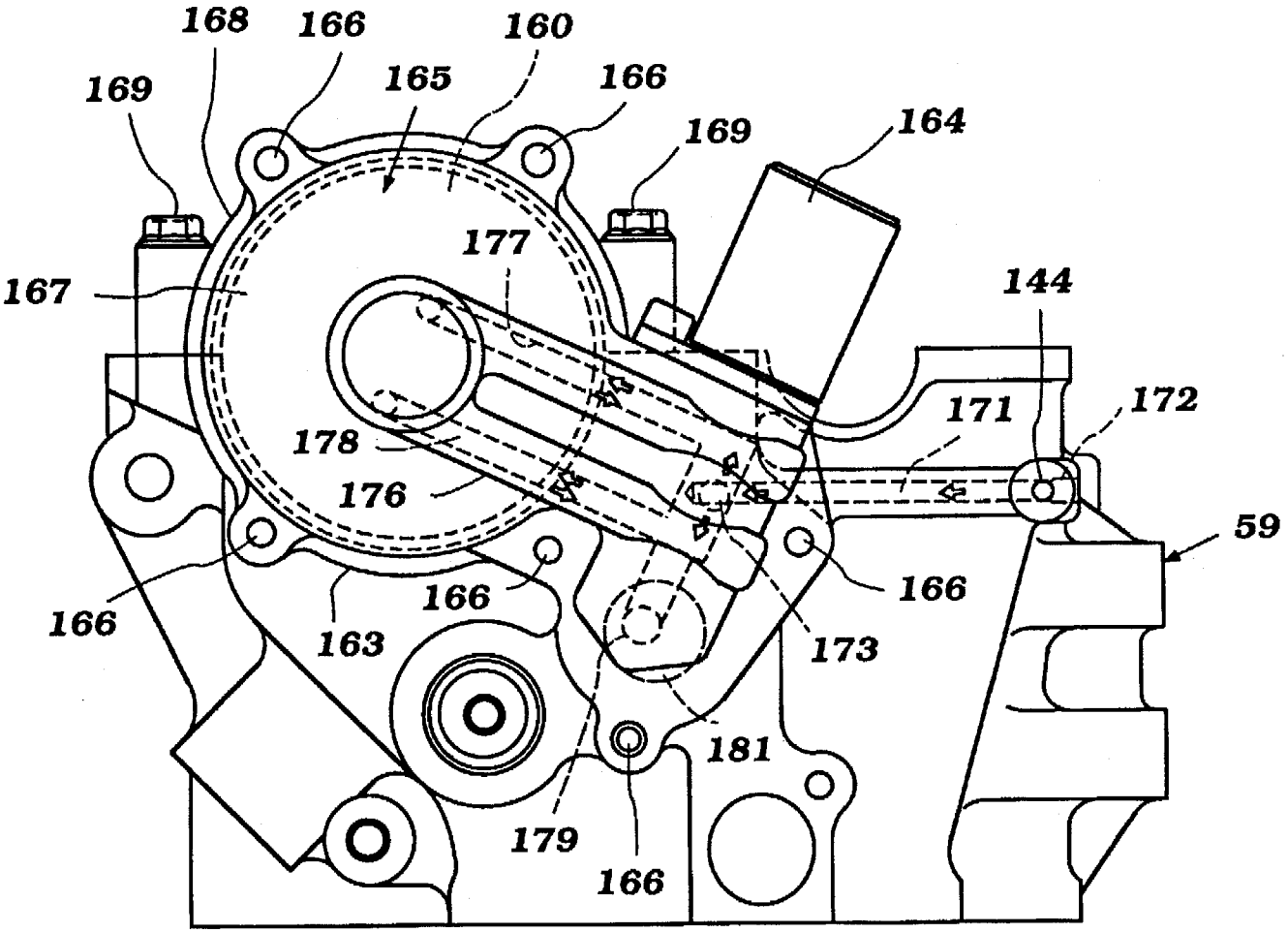
FIG. 4 is an enlarged front elevational view showing the external configuration of the variable valve timing control mechanism.
Figure 4:
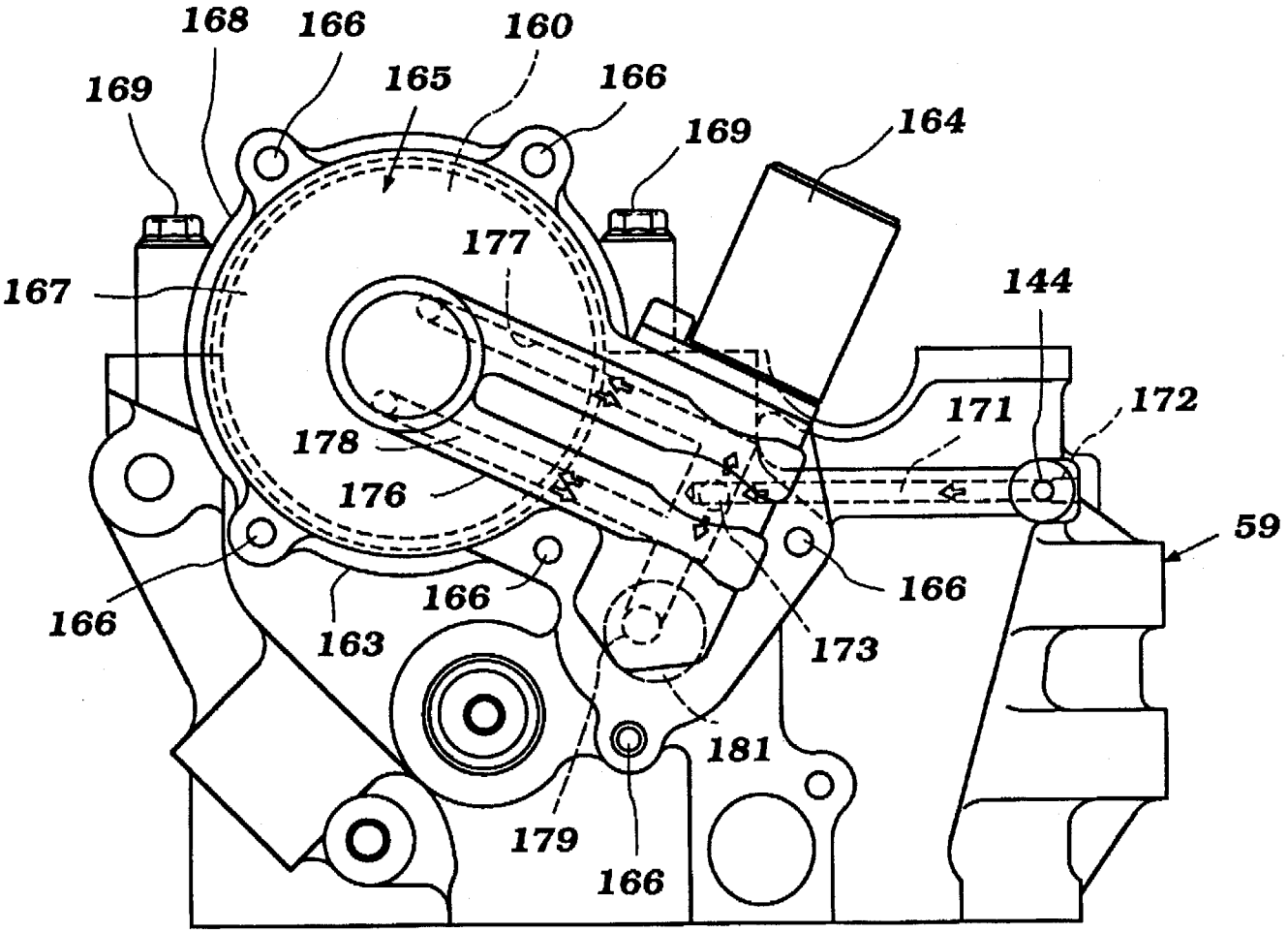
Figure 6:
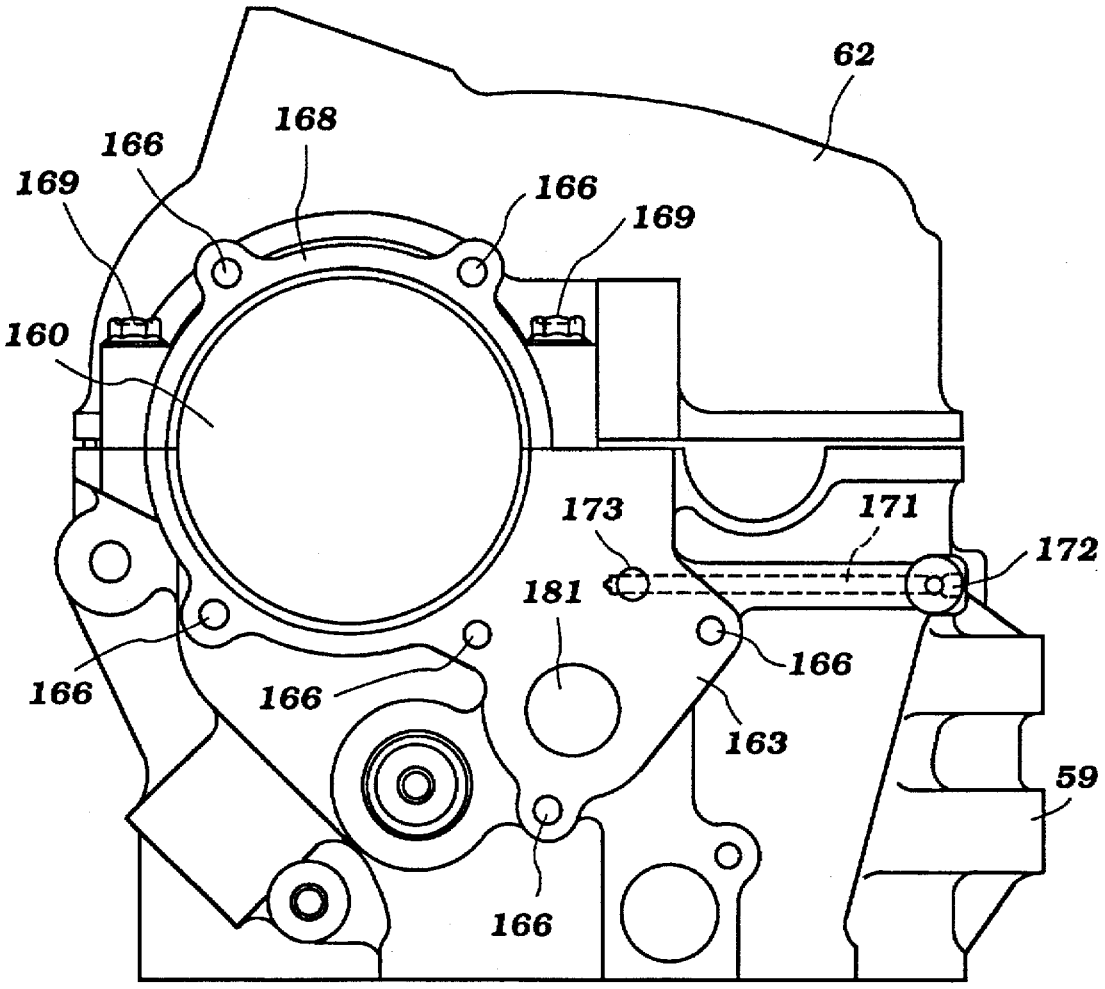
FIG. 6 is a view looking in the same direction as FIG. 4 but with the variable valve timing control mechanism removed.

Referring now additionally to FIG. 2, this is a view showing all of the engine driven accessories driven by the belt 24 removed as well as a front timing case cover 56. In addition, the alternator mounting bracket 49 is removed. It will be seen that the engine 21 is comprised of two major castings, one of which comprises a cylinder block 57 having a front face 58 which is enclosed by the timing case cover 56. A cylinder head casting 59 is affixed to the cylinder block 57 in a known manner. The cylinder block 57 and cylinder head 59 have internal cooling jackets which may have generally any known configuration, and only a portion of the cylinder block cooling jacket will be described later.

The lower end of the cylinder block 57 is enclosed by a crankcase member 61 that is affixed to it and which contains the crankshaft 22 and contains lubricant for the engine 21.

As will become apparent, the engine 21 is of the twin overhead cam type, and the cylinder head 59 mounts a pair of camshafts which are enclosed by a cam cover 62 that is affixed to the cylinder head 59 in a well known manner. This camshaft arrangement and the drive therefor will now be described.

Figure 10:
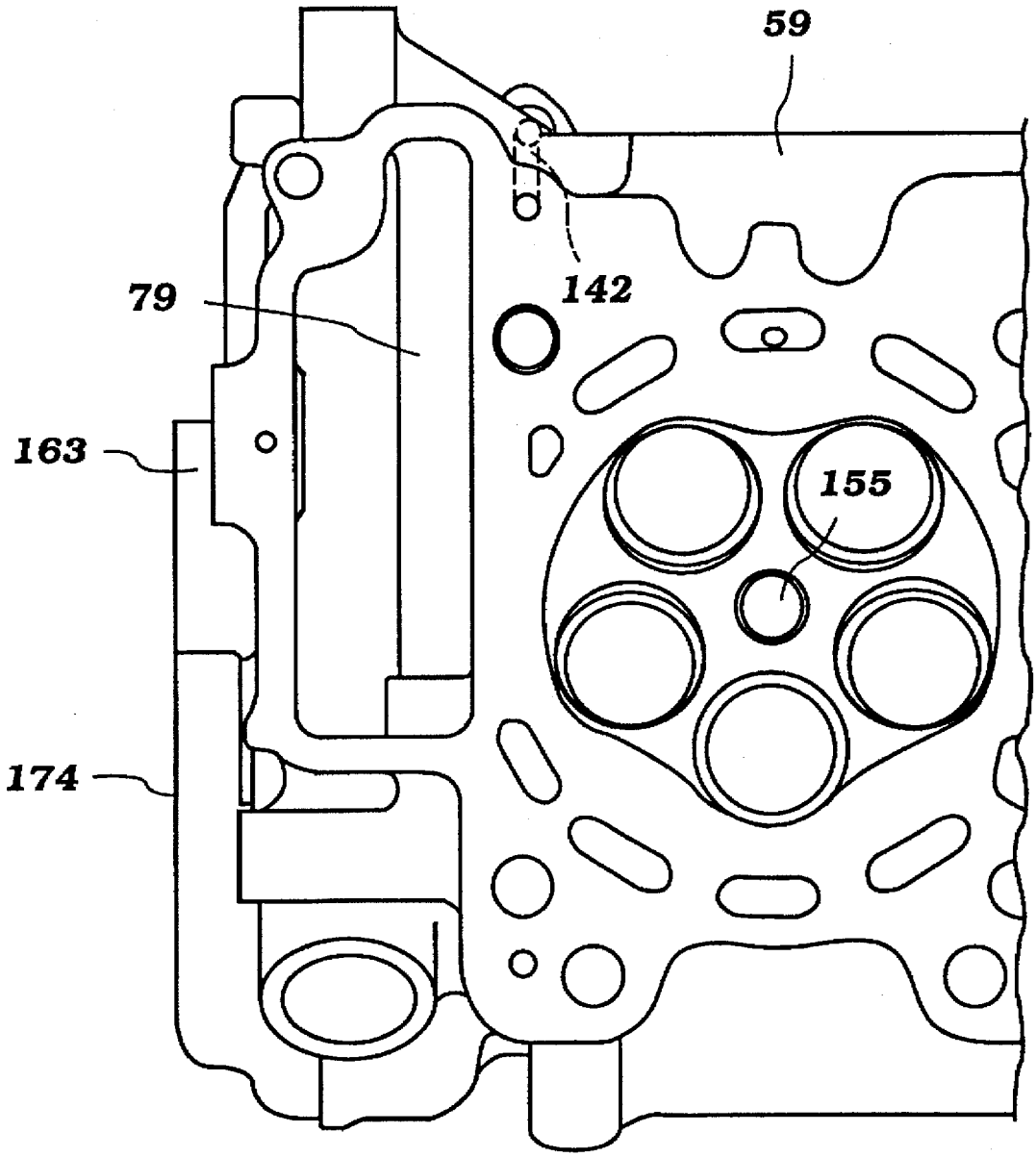
FIG. 10 is a bottom plan view of the cylinder head with the valve mechanism removed.

The cylinder head 59 has a 5-valve-per-cylinder arrangement, including 3 intake valves for each cylinder of the engine which are formed on one side of the cylinder head 59, the left-hand side as seen in the Figures (see particularly FIG. 10). These intake valves are all operated directly by an overhead mounted intake camshaft 63 that is journaled in a known manner which includes integral journals 64 (FIG. 8) formed in the cylinder head 59. On the other side of the cylinder head 59, there are provided a pair of exhaust valves (not shown, but see also FIG. 10) for each cylinder which are operated by an exhaust camshaft 65, which is also rotatably journaled by integral journals 66 formed in the cylinder head 59 in a well known manner. The intake and exhaust valves may be supported in an orientation of the type disclosed in U.S. Pat. No. 4,660,529, issued Apr. 28, 1987 in the name of Masaaki Yoshikawa, entitled "Four-Cycle Engine", now reissued as RE 33,787, and which patent and reissue are assigned to the assignee hereof.

The camshafts 63 and 65 are driven in timed relationship relative to the crankshaft 22 at one-half crankshaft speed, as is well known in this art. This timing drive, in the illustrated embodiment, is of the two-stage type and includes a first timing chain 67 which is driven by a sprocket 68 affixed to the crankshaft 22 and within a timing case 69 formed in part by the front face 58 of the cylinder block 57 and closed in part by the cover 56. This timing chain 67 drives a cam driving shaft 71 which is journaled in the cylinder head 59 in a suitable manner and which cam driving shaft 71 is disposed to one side of the cylinder head 59. That is, it is offset closer to the exhaust camshaft 65 than to the intake camshaft 63.

A two-stage sprocket 72 is affixed to the cam driving shaft 71, and its larger diameter portion 73 is driven by the timing chain 67. The smaller diameter portion 74 of the two-stage sprocket 72 is engaged with a second timing chain 75 which, in turn, engages sprockets 76 and 77 affixed to the intake and exhaust camshafts 63 and 65, respectively, so as to drive them. The 2 to 1 speed reduction between the crankshaft 22 and the camshafts 63 and 65 may be derived in any proportion between the sprocket 68, two-stage sprocket 72, and the camshaft sprockets 76 and 77.

Because the cam driving shaft 72 is offset to one side of the cylinder head 59 and cylinder block 57, it is possible to provide a chain tensioner, indicated generally by the reference numeral 78, on the other side of the timing case 69, as seen in FIG. 2. This chain tensioner 78 includes a shoe 81 that is engaged with the slack or return side of the timing chain 67 and which is engaged by a hydraulically urged plunger 82 that extends into a cavity 83 formed in the cylinder block 57 at one side thereof. A coil compression spring places an initial force on the tensioner shoe 81 and the plunger 82 is retained in place by a retainer nut 84 so as to maintain the desired tension on the chain 67, as is well known in this art. The shoe is pivoted relative to the chain 67 upon a pivot bolt 85 fixed to the cylinder block 51.

Figure 11:
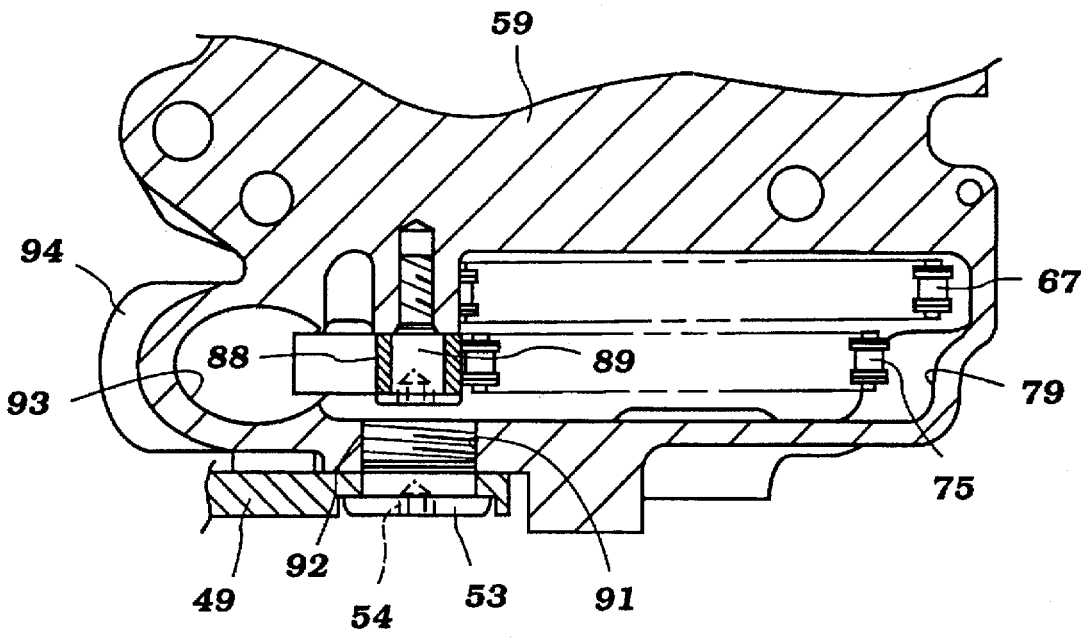
FIG. 11 is an enlarged cross-sectional view taken along the line 11—11 of FIG. 1 showing how the timing chain tensioning adjustment may be made.
Figure 12:
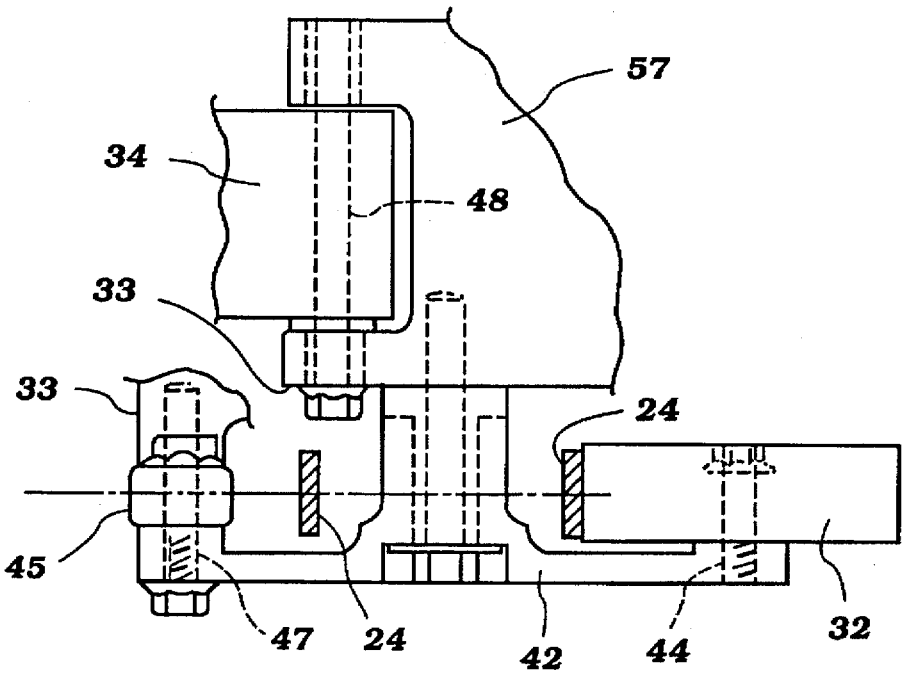
FIG. 12 is a top plan view looking generally in the direction of the arrow 12 in FIG. 1 and shows the belt tensioner mechanism.

The offsetting of the cam driving shaft 71 also permits the positioning of a further tension, indicated generally by the reference numeral 86 within the timing case cavity 79 formed integrally with the cylinder head 59. This tensioner 86 includes a guide pad 87 which is mounted on a lever 88 (see also FIG. 11) within the timing case cavity 79 by means of a pivot bolt 89. The axis of the pivot bolt 89 is aligned with a tapped opening 91 formed in the outer face of the cylinder head 59. This opening receives a threaded portion 92 of the fastener 53. As aforenoted, the fastener 53 serves the added function of maintaining the alternator supporting bracket 49 to the cylinder head 59. However, without removing the bracket 49, the fastener 53 may be removed and the tensioner mechanism 86 serviced and adjust it.

A hydraulically urged sliding plunger 92 is supported in a bore 93 formed in a protuberance 94 formed at one side of the cylinder head 59. A retaining device 95 cooperates with the plunger 91 so as to hold the shoe 87 in the desired adjusted position.

As has been noted, the engine 21 is provided with a lubricating system, and this includes lubricant which is contained within the oil pan 61. An oil pump 96 having a pump drive shaft 57 is contained within the oil pan 61 and is driven by a chain 97 which is, in turn, driven by another portion of the crankshaft sprocket 68. Lubricant is circulated in a manner which will be described in more detail later through the engine lubricating system.

This system includes an oil filter 98 that is surrounded by an oil cooling jacket 99 to which engine coolant is delivered, in a manner which will be described in conjunction with the description of the cooling system for the engine.

The oil pump 96 draws lubricant from within the crankcase through a strainer 101 and an inlet pipe 102. The oil pump 96 supplies this pressurized lubricant then through a discharge conduit 103 formed in the crankcase to an inlet fitting 104 formed in the front of the lower portion of the cylinder block 57. The continuing path through the oil filter 98 will be described later.

It should be noted that the engine 21 is designed so as to be operated not in an upright position as shown in FIG. 3 but rather in a forwardly inclined position. Thus, in normal operation and before the engine is running the level of lubricant in the crankcase 61 will be as represented by the line $L_1$ in FIG. 2. When the engine is running, however, the oil pump 96 will draw the lubricant down to the level $L_2$. As has been previously noted, the path of the lubricant through the engine 21 will be described later.

Figure 13:
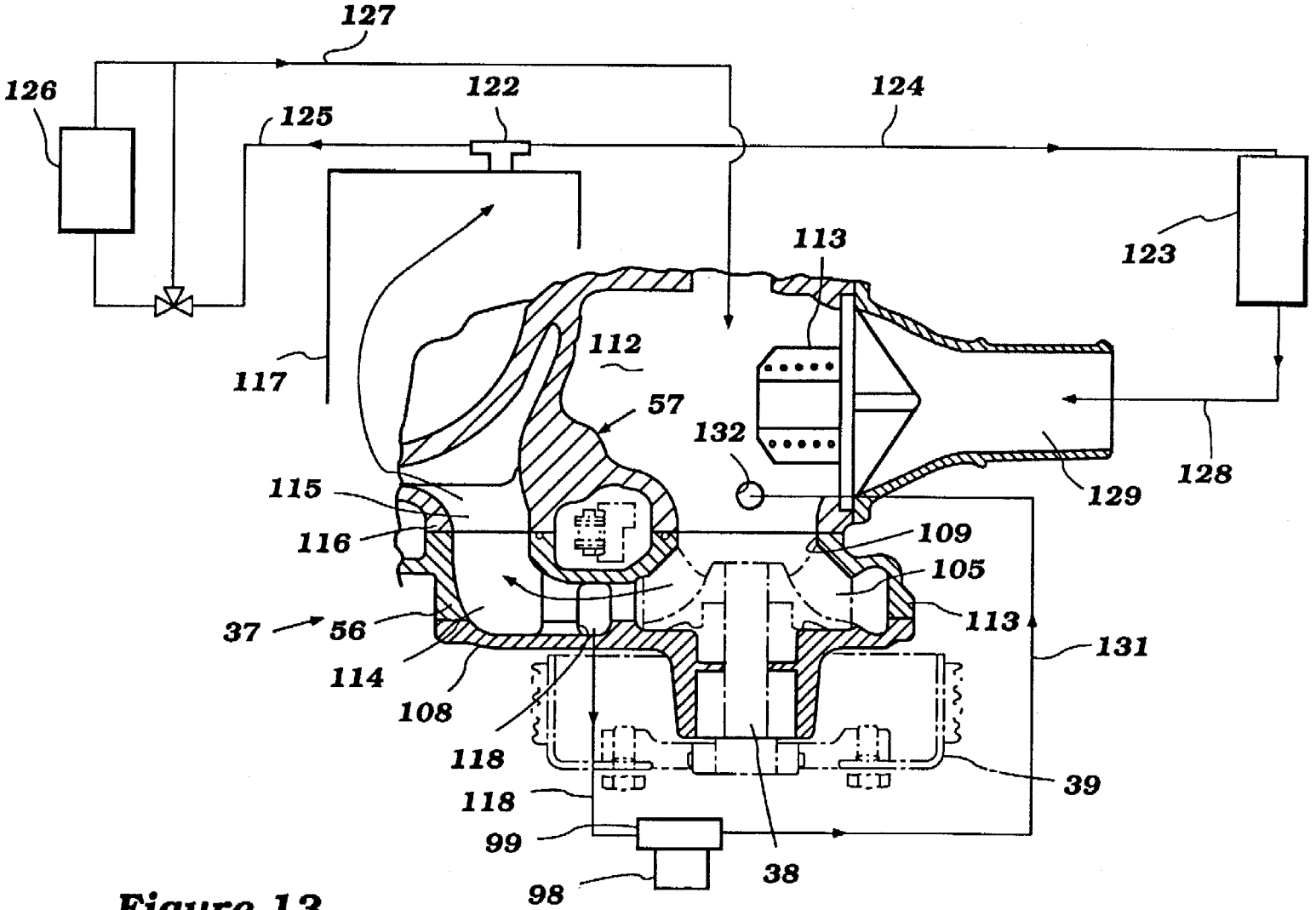
FIG. 13 is a cross-sectional, partially schematic view showing the interrelationship of the water pump and the oil cooler arrangement as well as showing other components of the engine cooling system schematically.
Figure 14:
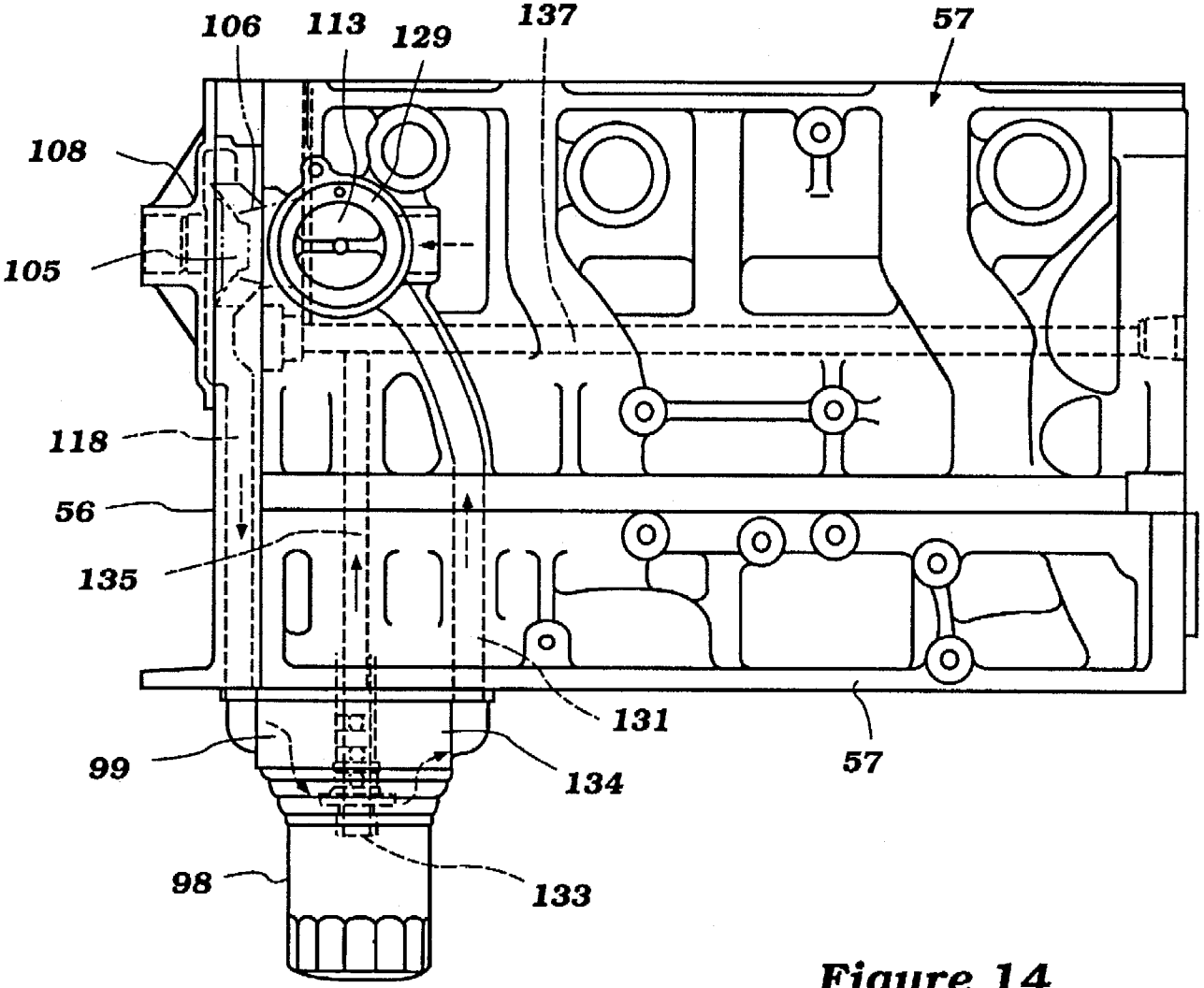
FIG. 14 is a side elevational view of the lower front portion of the engine taken generally in the direction of the arrow 14 in FIG. 1 and shows the details of the oil filter and oil cooler arrangement.

Also, it should be noted that the engine employs a variable valve timing mechanism which, in the illustrated embodiment, is effective only to vary the timing of the intake camshaft 63 relative to the crankshaft 22. As will become apparent from the following description, however, variable valve timing mechanisms may be employed for both the intake camshaft 63 and the exhaust camshaft 65. How this is done will be better understood later by reference to the detailed description of this variable valve timing mechanism. Referring now primarily to FIGS. 13 and 14, it will be seen that the timing case cover 56 is provided with a cavity 105 that receives an impeller 106 of the coolant pump assembly indicated, as previously noted, generally by the reference numeral 107. This impeller 106 is also shown in FIG. 3 for orientation purposes.

A coolant pump cover piece 109 is affixed to the timing case cover 56 in an appropriate manner and provides a journal for the impeller shaft 38 of the coolant pump 107. The rear of the timing case cover 56 is provided with an opening 109 which cooperates with a corresponding opening 111 (see also FIG. 2) formed in the front of the cylinder block 57 in its face 58 on the outer side of the timing case 69. This opening 111 communicates with a thermostat cavity 112 in which a thermostat assembly 113 is provided. The flow of coolant through the engine will be described later by primary reference to FIG. 13.

When the impeller 106 is driven by the drive belt 24, coolant will be drawn from the chamber 112 through the openings 111 and 109 and discharged through a scroll portion formed in a protuberance 113 of the timing case cover 56 to a discharge passageway 117 that is formed by the timing case cover 56 and the water pump cover 108. A portion of this coolant will be delivered to the engine cooling jacket through a coolant inlet opening 115 formed in the front face of the cylinder block 57 (see also FIGS. 2 and 3).

It will be seen that this cylinder block opening 115 is positioned in the timing case portion 69 and is surrounded by the timing chain 67. A flange 116 extends outwardly in sealing relationship with the timing case 56 so as to ensure against coolant leakage.

From the inlet opening 115, coolant flows to the cylinder block cooling jacket, which appears partially in FIG. 13 and which is identified by the reference numeral 117. The remaining flow of the coolant will be described later by reference to FIG. 13.

The coolant pump cover 103 and timing case cover 56 form a further coolant passageway 118 (FIGS. 13 and 14) that extends from the passageway 114 downwardly along the front of the engine to a discharge opening that communicates with a passageway 119 (FIG. 15) formed in the cylinder block 57 and which terminates in a water inlet opening boss 121 of the oil cooler 99.

The remainder of the coolant flow path will now be described by continued reference to FIG. 13. As has been noted, the coolant pumped by the coolant pump 37 is delivered to the cylinder block cooling jacket 117 through the inlet 115. This coolant then circulates through the remainder of the cooling jackets of the engine 21 and is discharged through a discharge fitting 122 which communicates with the heat exchanger or radiator 123 through a conduit shown schematically at 124. In addition, a branch passage 125 extends to a heater core 126 of the heating/air conditioning system of the vehicle. This coolant is returned to the cylinder block thermostat cavity 112 through a return conduit 127.

Coolant from the radiator 123 will flow into the thermostat cavity 112 when the thermostat 113 is opened through a conduit 128 that communicates with a thermostat housing 129 that is affixed to the cylinder block 57 in a well-known manner. The coolant from the oil cooler 99 is returned also to the thermostat cavity 112 of the cylinder block 57 through a conduit shown schematically at 131 and which is formed entirely in the cylinder block 57. This conduit terminates in a port 132 formed in the cylinder block 57 and which communicates with the cavity 112.

Figure 15:
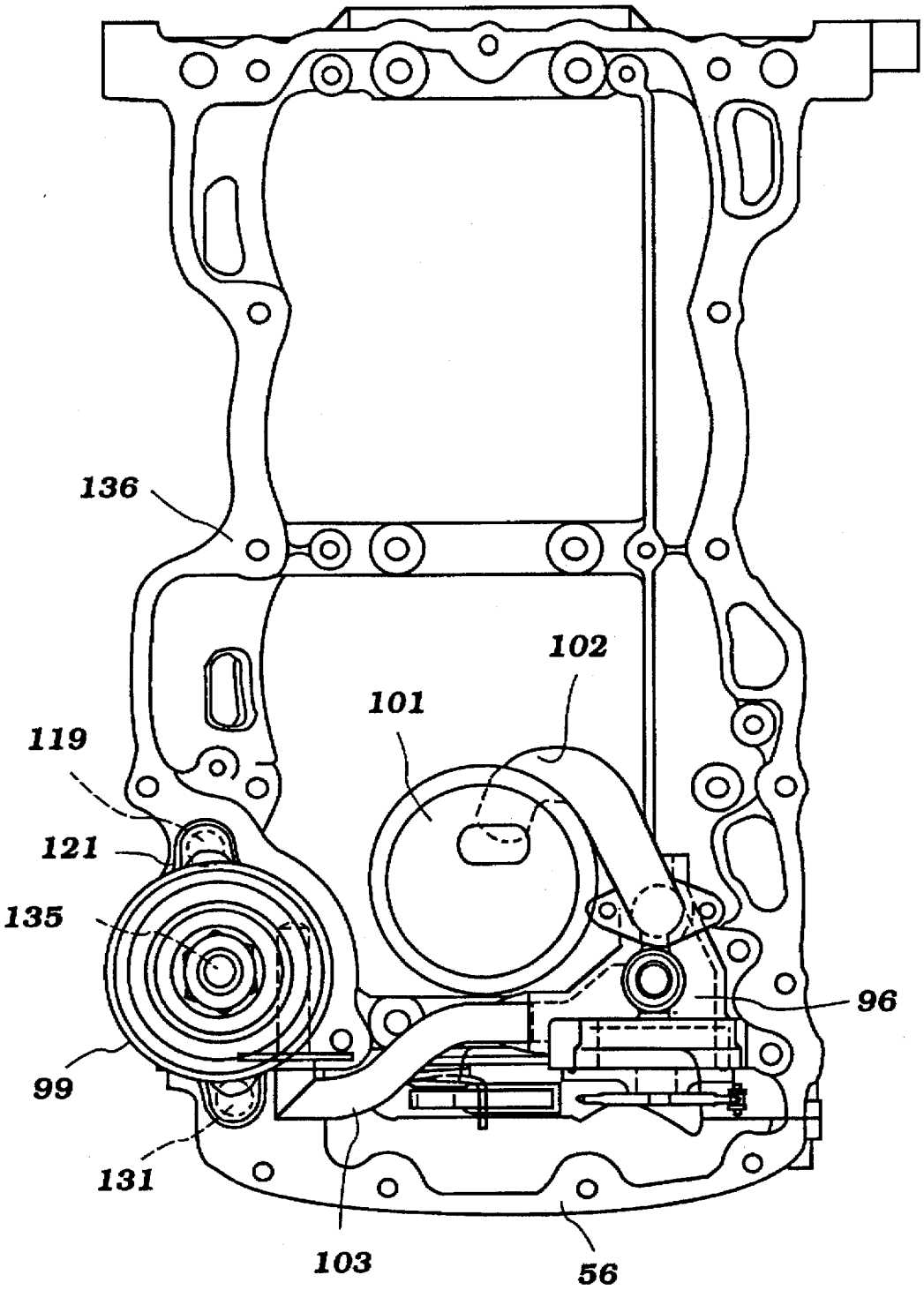
FIG. 15 is a bottom plan view of the cylinder block looking generally in the direction of the arrow 15 in FIG. 1 with the oil pan removed and shows the interrelationship between the oil pump, and the oil filter.

The remainder of the construction of the lubricating system will be now be described by particular reference to FIGS. 3–10, 14, and 15. Referring initially to FIGS. 3, 14, and 15, as has been noted, the oil pump 36 delivers lubricant to the oil cooler 99 and oil filter 98 through the conduit 103 and fitting 104 formed integrally with the cylinder block 57.

The oil filter 98 is of the canister, throw-away type and is threaded onto a receiving threaded nipple 113 that is tapped into an opening in the cylinder block 57 that extends through the oil cooler 99 and specifically its cooling jacket, shown schematically in FIG. 14 and indicated by the reference numeral 144. The oil flows through the oil filter element and then passes through the threaded nipple 133 for entry into a main delivery passage 135 which may be drilled or otherwise formed in the cylinder block 57 and which extends upwardly through a lower face 136 thereof. This lower face 136 is sealingly engaged by the crankcase member 61.

As thus seen in FIG. 3, this main delivery passage 135 extends upwardly and intersects a longitudinally extending main oil gallery 137 that is formed in the cylinder block 57 and which extends along the side thereof at a point approximately midway between the crankshaft 22 and the water pump 37. It should be noted that the water pump 37 is disposed on one side of a horizontal plane containing the axis of rotation of the crankshaft 22 while the oil pump 96 is on the other side of this plane. This positioning permits the water pump 37 to be in close proximity to the main water jackets of the cylinder block 57 and cylinder head 59. On the other hand, it also permits the oil pump 96 to be positioned close to and within the crankcase chamber formed by the oil pan 61 and close to the oil filter 98. This reduces the length of the supply conduit and also reduces the necessity for external conduits.

The main oil gallery 137 is intersected by a plurality of cross-drilled passageways 138 which extend downwardly to the main bearings in which the crankshaft 22 is journaled for their lubrication. In addition, one of these passages 138 is intersected by a further drilled passageway 139 which extends to the lowermost chain tensioner assembly 78 so as to act on its hydraulic plunger 82 as aforenoted.

At the front of the cylinder block 57 there is formed a vertically extending supply passageway 141 which cooperates with a corresponding supply passageway 142 of the cylinder head 59. These passageways 141 and 142 deliver lubricant to the cylinder head 59 for lubrication of the camshaft and valve actuating mechanism and also for operating the variable valve timing mechanism.

The lubricating structure associated with the cylinder head is thus shown in FIGS. 3 through 10 and will initially be described by primary reference to FIGS. 3 and 7 through 10. It will be seen that the cylinder head drilled oil passageway 142 extends generally vertically upwardly at an inclined angle so as to pass toward the outer peripheral edge of the cylinder head 59. Near the upper surface of the cylinder head 59, there is provided an axially extending passageway 143 formed by a drilling that extends through the front face of the cylinder head 59 and which intersects the drilling 142. The outer or forward end of this drilling 143 is closed by a plug 144.

Figure 7:
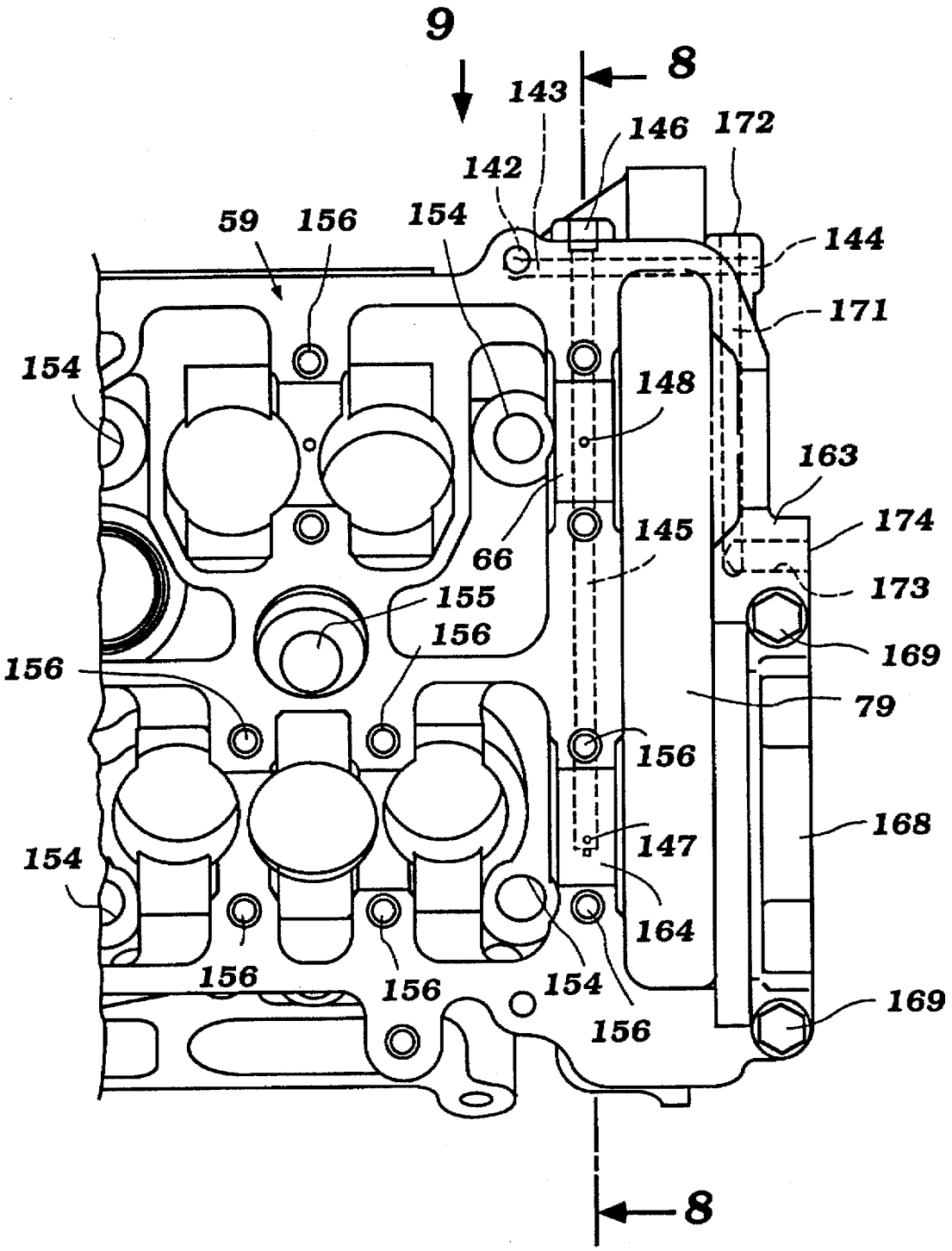
FIG. 7 is a top plan view, in part similar to FIG. 5 but the valve actuating mechanism and camshaft drive mechanism have been removed so as to more clearly show the lubricating passages associated with these mechanisms.
Figure 8:
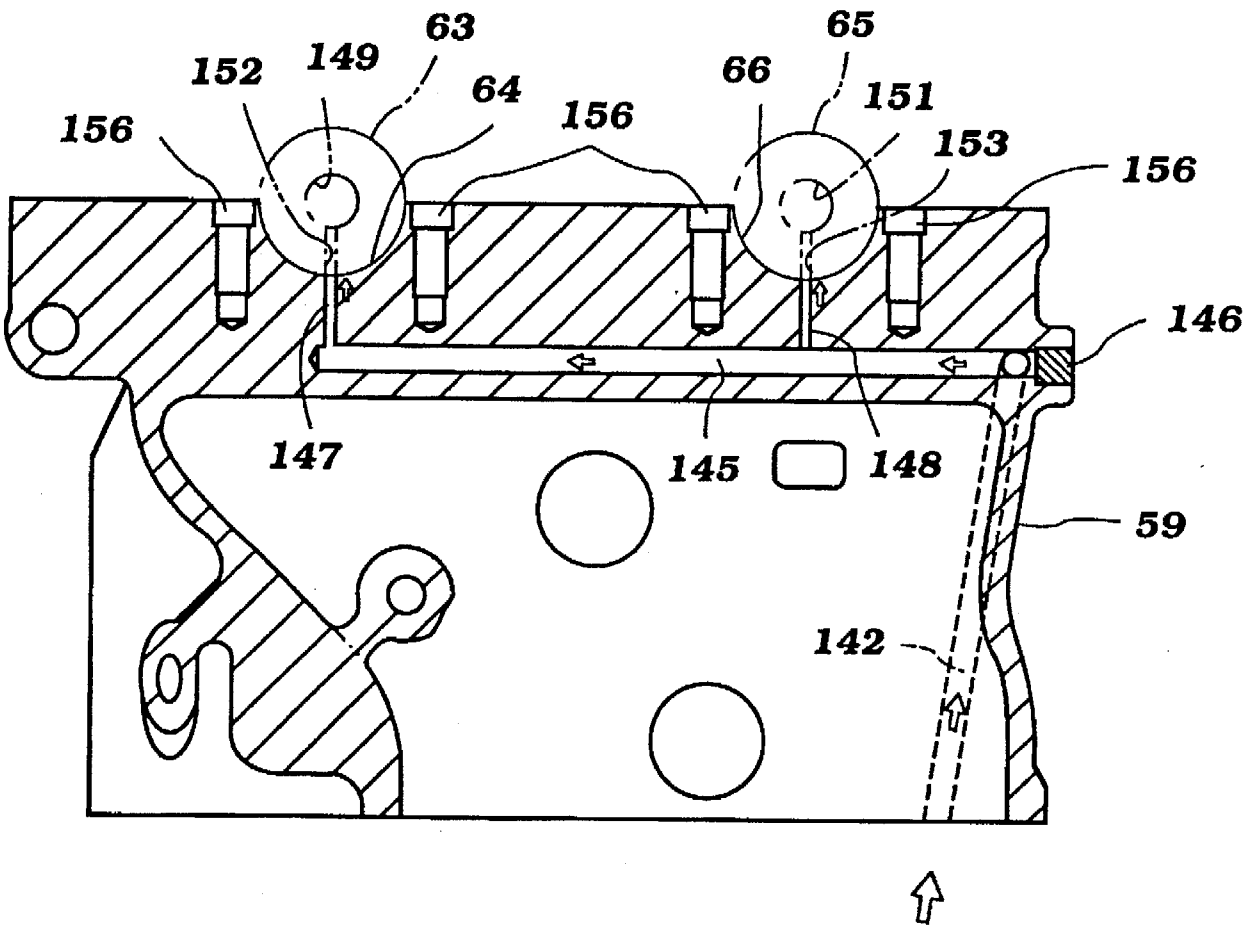
FIG. 8 is a cross-sectional view taken along the line 8—8 of FIG. 7.
Figure 9:
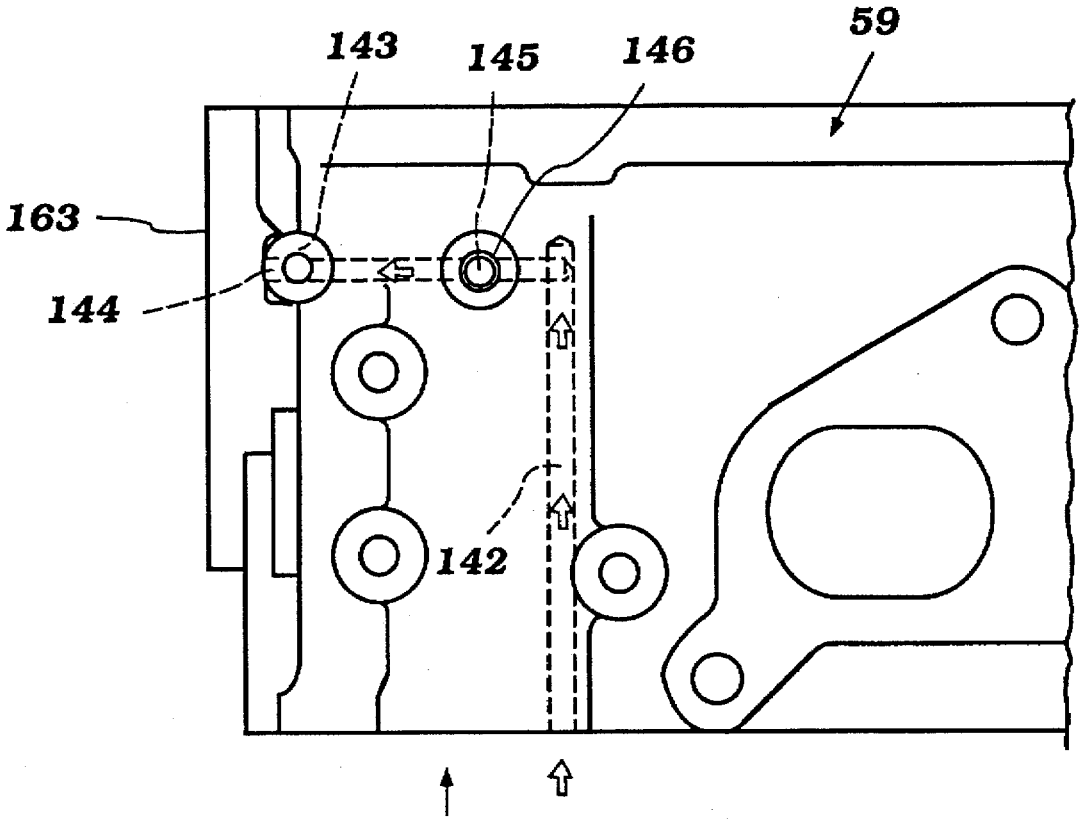
FIG. 9 is a side elevational view looking in the direction of the arrow 9 in FIG. 7.

A transversely extending drilling 145 intersects the passageway 144 adjacent the drilling 142 and has its outer end closed by plug 146. The passageway 145 extends below the cylinder head bearing surfaces 64 and 66 in which the front end of the input and exhaust camshaft 63 and 65 are journaled as best seen in FIGS. 7 and 8. Drillings 147 and 148 extend from these bearing surfaces 64 and 66 to the drilling 145 so that lubricant will be delivered to the bearing surfaces 64 and 66.

In addition, the camshaft 63 and 65 are formed with axially extending drilled passageways, shown in phantom in FIG. 8 and identified by the reference numerals 149 and 151. These passageways 149 and 151 form galleries by which lubricant is delivered to the cam surfaces of the camshaft and also, if desired, its bearing surfaces. Hence, the adjacent bearing surfaces of the camshaft are also formed with drillings 152 and 153 so as to permit this flow of lubricant.

As may be seen in FIG. 7, the cylinder head casting 59 is formed with spaced openings 154 that receive threaded fasteners (not shown) so as to affix the cylinder heard 59 to the cylinder block 57. In addition, tapped spark plug receiving openings 155 are formed in the cylinder head centrally over each of its cylinder bores. Spark plugs are received therein for firing the charge in the combustion chambers in a well known manner.

In addition, tapped openings are formed in the cylinder head 59 on opposite sites of the camshaft bearing surfaces including the bearing surfaces 64 and 66 and receive locating pins 155 for aligning cam bearing caps therein and also for receiving threaded fasteners (not shown) to fix the cam bearing caps to the cylinder head for completing the journaling of the camshafts 63 and 65.

Returning now to the lubricating system, it has been noted that a variable valve timing mechanism may be employed for controlling the timing of one or both of the camshafts 63 and 65 relative to the crankshaft 22. In the illustrated embodiment, such a variable valve timing mechanism is associated with only the intake camshaft and this mechanism will now be described as well as the operating system for it.

The variable valve timing mechanism, per se, appears best in FIG. 5 and is identified generally by the reference numeral 157. It will be seen that the intake camshaft sprocket 76 is coupled to an outer housing element 158 of this variable valve timing mechanism 157 and effects its rotation when driven by a timing chain 75. A hydraulically operated piston 159 is slidably supported within a chamber defined by the housing case 158 and divides it into two fluid cavities which are pressurized, in a manner to be described, so as to effect control of the axial position of the piston 159. This mechanism extends, in part, through an opening 160 formed in the front surface of the cylinder head 57 and the cam cover 62. This opening 160 is closed in a manner which will be described.

The piston 159, in turn, has a helically splined connection to a drive sleeve 161. This drive sleeve 161 is connected by means of a fastener 162 and a splined connection to the intake camshaft 63. As a result of the helically-splined connection between the drive piston 159 and the drive sleeve 161, the axial position of the piston 159 will control the angular relationship between the sprocket 76 and the camshaft 63 and, therefore, provide a means for controlling the timing of the opening and closing of the intake valve operated by the intake camshaft 63.

By placing the variable valve timing mechanism 157 at the front end of the intake camshaft 63 that becomes quite accessible. The manner in which this is done will, as should be apparent, permit this system to be readily adapted to existing engines or families of engines. In addition, the actuating and control mechanism for this variable valve timing mechanism 157 is also located so that it can be mounted adjacent to a boss assembly 163 that is formed on the cylinder head 59 at one side thereof.

The control mechanism, which includes a solenoid operated control valve 164 is mounted on a cover plate, indicated generally by the reference numeral 165 which is affixed to the front of the cylinder head 59 on the boss 163 by means of threaded fasteners 166. This cover 165 is also so affixed to the cam cover 62 and serves to close the opening 160. This cover 165 has a portion 167 which encloses the variable valve timing mechanism 157. In addition, a retainer bracket 168 is affixed to the cylinder head boss 163 by threaded fasteners 169.

The cover plate 165 and specifically the portion 167 cooperate with the variable valve timing mechanism 157 to provide in part the flow path between the Solenoid operated valve 164 and the piston 159 for its control as will now be described. Referring now primarily to FIGS. 4–7, the cylinder head drilling 143 is intersected on the front of the cylinder head 59 by a further cross-drilling 171 the outer end of which is closed by a plug 172. This cross-drilling 171 extends transversely across the front of the cylinder head and terminates adjacent the boss 163 on which the cover plate 165 is mounted. A further drilling 173 extends through a front face 174 of the boss 163 and intersects this drilling 171. Hence, this provides a supply of fluid under pressure that can enter into a corresponding passageway 175 that is formed in the cover assembly 165 and specifically a block portion 176 thereof.

This passageway 175 cooperates with a suitable spool-type valve operated by the solenoid 164 for selectively pressurizing or depressurizing one of two passageways 177 and 178 formed in the boss portion 176 of the cover plate 175. In addition, the valve operated by the solenoid 164 can return pressure from either side of the piston 159 to a drain passageway 179 that has formed in the cover plate 165 and which communicates with a corresponding drain passageway 181 formed in the front of the boss 163 in its surface 174. This drain passageway 181 communicates with the timing case 79 so that lubricant drain from the variable valve timing control mechanism and specifically the control piston 159 to the crankcase chamber.

The control passageways 177 and 178 cooperate with a supply member 179 that is captured within the cover plate portion 167 and which extends into the hollow sleeve 161. Thus, oil under pressure may be supplied through the path shown best in FIG. 5 to opposite sides of the piston 159 in a controlled fashion so as to control the axial position of the piston 159 and the timing of the intake valve camshaft 63 in the manner previously described.

Hence, this construction provides a very compact and easily serviced control for the variable valve timing mechanism 157. Also, the construction eliminates the need for any external oil passages. Also the system may easily be added to or deleted from existing engines. This gives the engine manufactured a wider variety of options at reduced costs.

Thus, from the foregoing description it should be readily apparent that the object of the invention are well fulfilled by the described construction. Of course, it should be understood that this construction is that of the preferred embodiment of the invention, and that various changes and modifications may be made without departing from the spirit and scope of the invention, as defined by the appended claims.

What is claimed is:

1. An internal combustion engine having an engine cylinder head upon which a camshaft is journaled at least in part, a cam cover affixed to said cylinder head and enclosing at least in part said camshaft, a timing drive at one end of said cylinder head for driving said camshaft from an engine crankshaft, a timing drive chamber formed at said one end of said at least in part by said cylinder head and said cam cover and containing at least in part said timing drive, a hydraulically operated variable valve timing mechanism for coupling said timing drive to said camshaft and for varying the timing of said camshaft relative to said crankshaft, said hydraulically operated variable valve timing mechanism extending at least in part between said cam cover and said cylinder head at said one end thereof, a timing drive cover affixed to said one end of said cylinder head and said cam cover and enclosing said variable valve timing mechanism and said timing drive chamber, a source of hydraulic fluid under pressure, and a valve assembly mounted upon said timing drive cover for controlling the supply of hydraulic fluid from said source to said variable valve timing mechanism for operating said variable valve timing mechanism.

2. An internal combustion engine as set forth in claim 1, wherein the hydraulic fluid is supplied to the variable valve timing mechanism through passages formed in the timing drive cover and extending between the valve assembly and the variable valve timing mechanism.

3. An internal combustion engine as set forth in claim 2, wherein the valve assembly includes a solenoid actuator mounted on the timing drive cover.

4. An internal combustion engine as set forth in claim 1, wherein the timing drive comprises a flexible transmitter.

5. An internal combustion engine as set forth in claim 4, wherein the source of hydraulic fluid comprises lubricant pumped by an oil pump of the engine.

6. An internal combustion engine as set forth in claim 5, wherein the oil pump is disposed on one side of the axis of rotation of the crankshaft and further including a water pump disposed on the other side of the crankshaft axis from the oil pump and closer to the camshaft than the oil pump.

7. An internal combustion engine as set forth in claim 6, further including an oil filter mounted on the engine on the same side of the crankshaft axis as the oil pump and an oil cooler juxtaposed to said oil filter and receiving coolant from the coolant pump for cooling the lubricating oil.

8. An internal combustion engine as set forth in claim 1, wherein the source of hydraulic fluid comprises lubricant pumped by an oil pump of the engine.

9. An internal combustion engine as set forth in claim 8, wherein the oil pump is disposed on one side of the axis of rotation of the crankshaft and further including a water pump disposed on the other side of the crankshaft axis from the oil pump and closer to the camshaft than the oil pump.

10. An internal combustion engine as set forth in claim 9, further including an oil filter mounted on the engine on the same side of the crankshaft axis as the oil pump and an oil cooler juxtaposed to said oil filter and receiving coolant from the water pump for cooling the lubricating oil.

11. An internal combustion engine as set forth in claim 10, wherein a pair of fluid passages supply coolant from the water pump to the oil cooler and wherein the inlet and outlets to the oil cooler are disposed at a point transversely between the oil pump and the water pump.

12. An internal combustion engine as set forth in claim 11, wherein the water is supplied from the water pump to the oil cooler through a water passage formed at least in part in a further front timing cover covering the timing drive and the return is formed in a cylinder block of the engine.

13. An internal combustion engine having an engine member upon which a camshaft is journaled at least in part, a timing drive comprised of a flexible transmitter at one end of said engine member for driving said camshaft from an engine crankshaft, a timing drive cover formed at said one end of said engine member at least in part by said engine member and containing at least in part said timing drive, a hydraulically operated variable valve timing mechanism for coupling said timing drive to said camshaft and for varying the timing of said camshaft relative to said crankshaft, a source of hydraulic fluid under pressure, a valve assembly mounted upon said timing drive cover for controlling the supply of hydraulic fluid from said source to said variable valve timing mechanism for operating said variable valve timing mechanism, a tensioner device engaged with said flexible transmitter and contained within said timing drive cover and mounted on a pivot bolt affixed to said engine member, said timing drive cover having an opening formed therein through which said pivot bolt is accessible, and further including an accessory bracket mounted to said timing drive cover by a fastener having a threaded connection to said opening for accessing said pivot bolt by removal of said threaded fastener.

14. An internal combustion engine as set forth in claim 13, wherein there are a pair of camshafts, each driven by the flexible transmitter.

15. An internal combustion engine as set forth in claim 14, wherein the flexible transmitter is driven by a drive sprocket pivotally journaled on the engine member within the timing drive cover.

16. An internal combustion engine as set forth in claim 15, wherein the driving sprocket is offset toward one of the camshafts and the tensioner member engages the part of the flexible transmitter extending between the driving sprocket and the other camshaft.

17. An internal combustion engine having an engine member upon which a camshaft is journaled at least in part, a timing drive comprised of a flexible transmitter at one end of said engine member for driving said camshaft from an engine crankshaft, a timing drive cover formed at said one end of said engine member at least in part by said engine member and containing at least in part said timing drive, a hydraulically operated variable valve timing mechanism for coupling said timing drive to said camshaft and for varying the timing of said camshaft relative to said crankshaft, a source of hydraulic fluid under pressure comprised of lubricant pumped by an engine oil pump, a valve assembly mounted upon said timing drive cover for controlling the supply of lubricant from said oil pump to said variable valve timing mechanism for operating said variable valve timing mechanism, said oil pump being disposed on one side of the axis of rotation of said crankshaft and further including a coolant pump disposed on the other side of said crankshaft axis from said oil pump and closer to said camshaft than said oil pump, an oil filter mounted on said engine on the same side of said crankshaft axis as said oil pump and an oil cooler juxtaposed to said oil filter and receiving coolant from said coolant pump for cooling the lubricant, and a pair of fluid passages supplying coolant from said coolant pump to said oil cooler and wherein the inlet and outlets to said oil cooler are disposed at a point transversely between said oil pump and said coolant pump.

18. An internal combustion engine as set forth in claim 17, wherein the water is supplied from the water pump to the oil cooler through a water passage formed at least in part in a further front timing cover covering the timing drive and the return is formed in a cylinder block of the engine.

19. An internal combustion engine having a camshaft journaled therein, a flexible transmitter driven by an engine crankshaft for driving said camshaft, said flexible transmitter being enclosed at least in part within a timing case, a transmitter tensioner associated with said flexible transmitter and supported on a pivot bolt for engaging said flexible transmitter and maintaining the tension therein, said pivot bolt being contained within said timing case, an outer surface of said timing case having a threaded opening aligned with said pivot bolt and through which said pivot bolt may be accessed, and an attachment bolt affixing an attachment to said timing case and having a threaded portion received within and closing said timing case opening, as well as affixing said attachment to said timing case.

20. An internal combustion engine as set forth in claim 19, wherein there are a pair of camshafts, each driven by the flexible transmitter.

21. An internal combustion engine as set forth in claim 20, wherein the flexible transmitter is driven by a drive sprocket pivotally journaled on an engine member within the timing case.

22. An internal combustion engine as set forth in claim 21, wherein the driving sprocket is offset toward one of the camshafts and the tensioner member engages the part of the flexible transmitter extending between the driving sprocket and the other camshaft.

23. An internal combustion engine as set forth in claim 22, wherein the source of hydraulic fluid comprises lubricant pumped by an oil pump of the engine.

24. An internal combustion engine as set forth in claim 23, wherein the oil pump is disposed on one side of the axis of rotation of the crankshaft and further including a water pump disposed on the other side of the crankshaft axis from the oil pump and closer to the camshaft than the oil pump.

25. An internal combustion engine as set forth in claim 24, further including an oil filter mounted on the engine on the same side of the crankshaft axis as the oil pump and an oil cooler juxtaposed to said oil filter and receiving coolant from the coolant pump for cooling the lubricating oil.

26. An internal combustion engine as set forth in claim 25, wherein a pair of fluid passages supply coolant from the water pump to the oil cooler and wherein the inlet and outlets to the oil cooler are disposed at a point transversely between the oil pump and the water pump.

27. An internal combustion engine as set forth in claim 26, wherein the water is supplied from the water pump to the oil cooler through a water passage formed at least in part in a further front timing cover covering the timing drive and the return is formed in the cylinder block of the engine.

28. An internal combustion engine comprised of a cylinder block closed at its lower end by a crankcase in which a crankshaft rotates, an oil pump driven from said crankshaft and disposed on the side of a plane containing the axis of said crankshaft opposite to said cylinder block, an oil filter for said engine mounted on a lower portion of said cylinder block and through which oil is circulated by said oil pump, said engine having a cooling jacket, a cooling pump driven by said crankshaft and positioned on the side of said plane on which said cylinder block lies, said oil filter being mounted on said engine on the same side of said crankshaft axis as said oil pump, an oil cooler juxtaposed to said oil filter, and means for circulating coolant from said cooling pump through said oil cooler.

29. An internal combustion engine as set forth in claim 28, wherein a pair of fluid passages supply coolant from the cooling pump to the oil cooler and wherein the inlet and outlets to the oil cooler are disposed at a point transversely between the oil pump and the cooling pump.

30. An internal combustion engine as set forth in claim 29, wherein the coolant supplied from the coolant pump to the oil cooler through a coolant passage formed at least in part in a further front timing cover covering the timing drive and the return is formed in a cylinder block of the engine.

* * * * *